US008142243B2

(12) United States Patent
Sakata et al.

(10) Patent No.: US 8,142,243 B2
(45) Date of Patent: Mar. 27, 2012

(54) OUTBOARD ENGINE UNIT

(75) Inventors: Shigekazu Sakata, Wako (JP); Norikazu Shimizu, Wako (JP); Hiroshi Mizuguchi, Wako (JP); Yoshio Ohtomo, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 148 days.

(21) Appl. No.: 12/767,240

(22) Filed: Apr. 26, 2010

(65) Prior Publication Data

US 2010/0273368 A1 Oct. 28, 2010

(30) Foreign Application Priority Data

Apr. 28, 2009 (JP) ..... P2009-109048

(51) Int. Cl.
*B63H 20/08* (2006.01)

(52) U.S. Cl. ..... 440/53; 440/61 S

(58) Field of Classification Search ..... 440/53, 440/61 S

See application file for complete search history.

(56) References Cited

U.S. PATENT DOCUMENTS 2,700,358 A * 1/1955 Johnson ..... 440/60
3,623,446 A * 11/1971 Shimanckas ..... 440/55
5,029,547 A * 7/1991 Novey ..... 440/60
7,465,202 B2 * 12/2008 Takada et al. ..... 440/61 S

FOREIGN PATENT DOCUMENTS

JP 2004-230949 A 8/2004

* cited by examiner

*Primary Examiner* — Lars A Olson
(74) *Attorney, Agent, or Firm* — Arent Fox LLP

(57) ABSTRACT

Outboard engine body is mounted via a swivel shaft to a stern bracket. Angle sensor, provided on the stern bracket, includes a contact having a maximum operating angle set to be not greater than half of a maximum steered angle of the engine body, and it outputs detection information indicative of an operating angle of the contact. Curved member is provided on the engine body and normally held in engagement with the contact, and it has a continuously varying radius of curvature from the central axis of the swivel shaft, so that the contact varies in operating angle while sliding along a curved outer peripheral surface of the curved member in response to steering operation. Thus, a steered angle is determined on the basis of the detection information from the angle sensor.

3 Claims, 7 Drawing Sheets

OUTBOARD ENGINE UNIT

FIELD OF THE INVENTION

The present invention relates to outboard engine units capable of detecting steered angles.

BACKGROUND OF THE INVENTION

Techniques for detecting a steered angle of an outboard engine by use of a rotational angle sensor have been known, one example of which is disclosed in Japanese Patent Application Laid-Open Publication No. 2004-230949 (JP 2004.230949 A).

FIG. 8 hereof illustrates the technique disclosed in JP 2004-230949 A. An outboard engine unit 100, which is mounted to a hull or body 101 of a boat via a stern bracket 102, has an outboard engine body 103 rotatably mounted to the stern bracket 102 via a swivel shaft 104. The outboard engine body 103 is steered about a central axis 106 of the swivel shaft 104 by a steerperson moving a tiller handle 105 horizontally leftward or rightward (i.e., toward or away from a person viewing the figure). A steered angle of the outboard engine body 103 is detected via a pivotal angle sensor 107 provided on the swivel shaft 104.

The outboard engine body 103 is sometimes steered through 50 degrees or more at the time of leftward or rightward steering. Thus, the pivotal angle sensor 107 is required to have a capability of detecting pivot angles of 100 degrees or more corresponding to a sum of such possible leftward and rightward steered angles.

However, the pivotal angle sensor 107 capable of detecting pivot angles of 100 degrees or more is expensive, increasing overall cost of the outboard engine unit 100. Thus, there has been a need for an outboard engine unit which is provided with an inexpensive steered angle detection mechanism and yet can achieve satisfactory performance.

SUMMARY OF THE INVENTION

In view of the foregoing prior art problems, it is an object of the present invention to provide an improved outboard engine unit which can achieve satisfactory performance even with an inexpensive steered angle detection mechanism capable of reducing cost of the outboard engine unit.

In order to accomplish the above-mentioned object, the present invention provides an improved outboard engine unit, which comprises: an outboard engine body mounted via a swivel shaft to a stern bracket fixedly connected to a body of a boat, the outboard engine body being horizontally pivotable relative to the stern bracket up to a predetermined maximum steered angle about the swivel shaft; an angle sensor provided on the stern bracket and including a contact having a maximum operating angle set to be not greater than half of the predetermined maximum steered angle, the angle sensor outputting detection information indicative of an operating angle of the contact; and a curved member provided on the outboard engine body and formed in a shape such that its radius of curvature from the center axis of the swivel shaft varies continuously, the curved member being normally held in sliding contact engagement with the contact in such a manner that the contact varies in its operating angle while sliding along a curved outer peripheral surface of the curved member in response to steering operation.

In the outboard engine unit of the present invention, the angle sensor, of which the contact (member) has the maximum operating angle not greater than the maximum steerable of the outboard engine, is provided on the stern bracket. The curved member held in sliding engagement with the contact is provided on the outboard engine body, and the curved member has a shape such that its radius of curvature from the swivel shaft continuously varies. Generally, angle sensors, of which the contact has a small maximum operating angle, are inexpensive. Because the steered angle detection mechanism in the present invention includes the curved member and the angle sensor whose operating angle is not greater than half of the maximum steered angle of the outboard engine body, the present invention can reduce the cost of the steered angle detection mechanism and hence the overall cost of the outboard engine unit. In addition, because a proven trim angle sensor can be used as the angle sensor, of which the contact (member) has the maximum operating angle not greater than the maximum steered angle of the outboard engine body, the present invention can achieve an enhance reliability of the steered angle detection mechanism.

Preferably, the outboard engine unit of the present invention further comprises a steering section for horizontally pivoting the outboard engine body about the swivel shaft, and the steering section includes an arithmetic section for calculating a steered angle of the outboard engine body on the basis of the detection information output from the angle sensor, and a display section for displaying the steered angle calculated by the arithmetic section. This arrangement allows a steerperson to visually check a steered angle of the outboard engine during travel and thus can achieve an enhanced operability.

Preferably, the curved outer peripheral surface of the curved member is of a generally arc shape having an imaginary center point offset from the central axis of the swivel shaft.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

Figure 1:
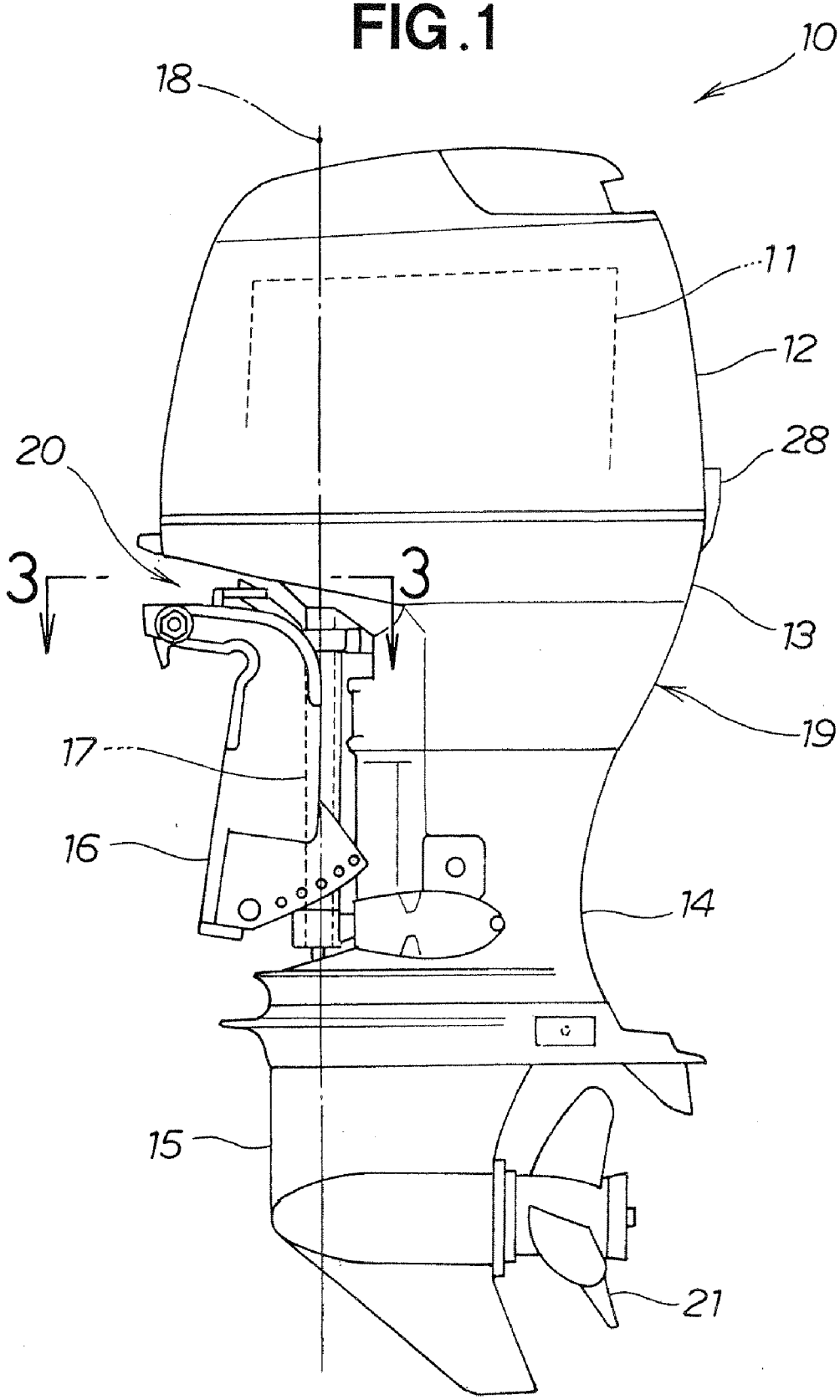
FIG. 1 is an overall side view of an embodiment of an outboard engine unit of the present invention.

Reference is now made to FIG. 1 which is an overall side view of an embodiment of an outboard engine unit of the present invention. As shown, the outboard engine unit 10 includes an outboard engine 11 provided in an upper section of the unit 10. The outboard engine 11 is a vertically placed engine with a cylinder and piton oriented horizontally and with a crankshaft and cam shaft oriented vertically. A direction in which a boat, having the outboard engine 11 mounted thereon travels forward, is a leftward direction in the figure.

The outboard engine unit 10 also includes: an upper engine cover 12 that covers an upper portion of the outboard engine 11; a lower engine cover 13 disposed under the upper engine cover 12 to cover a lower portion of the outboard engine 11; an extension case 14 disposed under the lower engine cover 13; and a gear case 15 disposed under the extension case 14.

The outboard engine 10 includes an outboard engine body 19 mounted via a vertical swivel shaft 17 to a stern bracket 16 that is in turn fixedly connected to a hull or body of the boat, and the engine body 19 is horizontally pivotable relative to the stern bracket 16 up to a predetermined maximum steered angle about a central axis (line) 18 of the swivel shaft 17. The outboard engine unit 10 also includes a steered angle detection mechanism 20 provided in a front region of the portion covered with the lower engine cover 13.

Behind the gear case 15 is disposed a propeller 21 rotatable by power produced by the outboard engine 11 to provide propelling power. The propeller 21 is switchable between forward rotation and reverse rotation via a pair of dog clutches, to thereby provide forward or rearward propelling power.

The upper engine cover 12 is mounted to the lower engine cover 13 by means of a rear fastener 28 with a hook engaged with a front inner surface of the lower engine cover 13.

Figure 2:
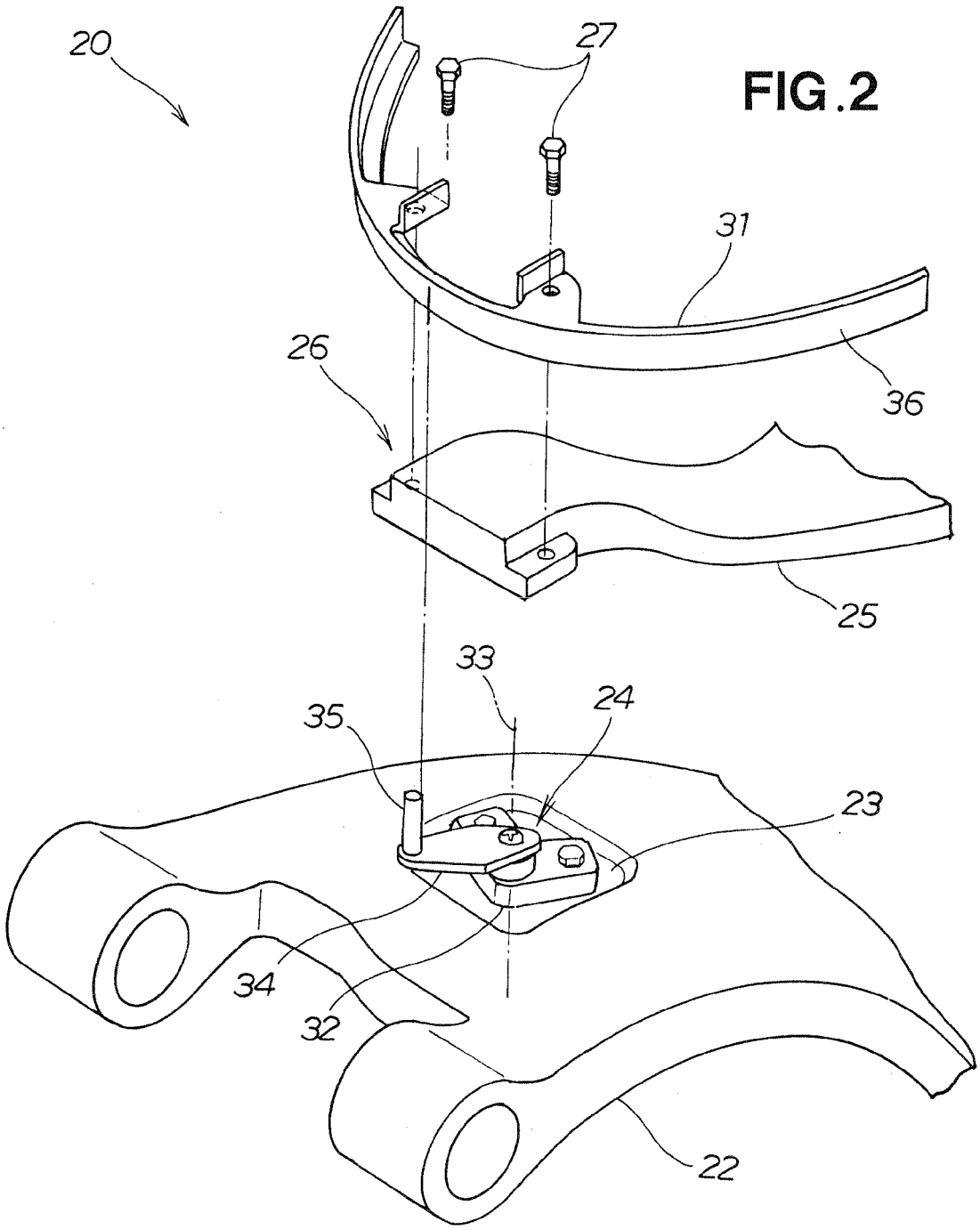
FIG. 2 is an exploded perspective view of a steered angle detection mechanism provided in the outboard engine unit of the present invention.

FIG. 2 is an exploded perspective view of the steered angle detection mechanism 20. As shown, the steered angle detection mechanism 20 includes: a swivel case 22 provided to face the stern bracket 16 (FIG. 1); an angle sensor 24 provided in a region 23 immediately over the swivel case 22; a mount frame 25 mounted on the swivel case 22 and having the swivel shaft 17 integrally incorporated therein; and a curved member 31 connected to a distal end portion 26 of the mount frame 25 by means of bolts 27.

The angle sensor 24 includes a sensor body section 32 mounted on the swivel case 22, a pivot member 34 mounted on the sensor body section 32 for pivoting movement about a vertical pivot axis 33, and a contact 35 provided at a distal end portion of the pivot member 34. The contact 35 is held in contact with a curved outer peripheral surface 36 of the curved member 31.

In the instant embodiment, an operating angle of the angle sensor 24 only has to be about half of the above-mentioned maximum or full steered angle of the outboard engine body 19, and thus, the angle sensor 24 may be an inexpensive angle sensor. The angle sensor 24 may comprise, for example, a trim angle sensor which measures a tilt angle of a jet nozzle provided at the stern of a jet propulsion boat and whose operating angle need not be so great.

Figure 3:
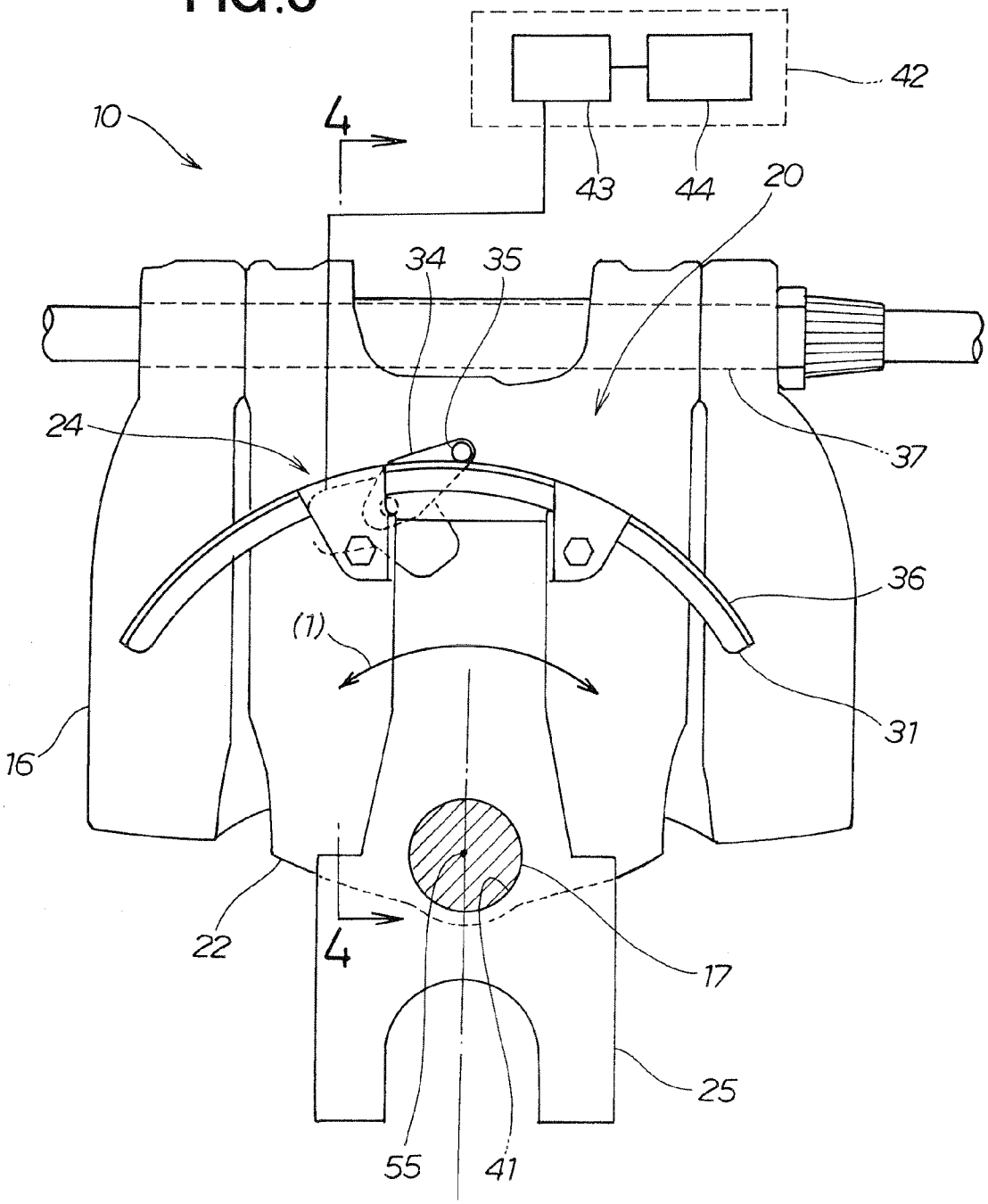
FIG. 3 is a sectional view taken along the 3-3 line of FIG. 1.

The following describe primary relevant sections of the embodiment of the outboard engine unit, with reference to FIG. 3 that is a sectional plan view of the outboard engine unit. As shown in FIG. 3, a tilting shaft 37 extends through the stern bracket 16 connected to the boat body. The swivel case 22 is pivotably mounted on the tilting shaft 37. The swivel case 22 has a bearing 41, via which the swivel shaft 17 is horizontally pivotably mounted. The mount frame 25 having the swivel shaft 17 integrally incorporated therein is pivotable about the swivel shaft 17 as indicated by arrow (1).

The contact 35 is normally urged in contact with the curved outer peripheral surface 36. In other words, the curved member 31 is normally held in sliding contact engagement with the contact 35. As the curved member 31 horizontally pivots together with the mount frame 25 in response to steering operation performed by a steerperson, the contact 35 slides along the curved outer peripheral surface 36.

The outboard engine unit 10 also includes a steering section 42 operable by the steerperson for pivoting the outboard engine body 19 (FIG. 1) about the swivel shaft 17. The steering section 43 includes an arithmetic section 43 for calculating a steered angle of the outboard engine body 19 on the basis of detection information, indicative of an operating angle of the contact 35, output from the angle sensor 24, and a display section 44 for displaying the steered angle calculated by the arithmetic section 42 to allow the steerperson to visually check the steered angle. The arithmetic section 43 may calculate the steered angle on the basis of the detection information using, for example, a memory-stored table having stored therein steered angles in association with possible operating angles of the contact 35. The steering section 42, which is shown only conceptually as a rectangular block in the figure, is where a steering handle operable by the steerperson is provided.

Figure 4:
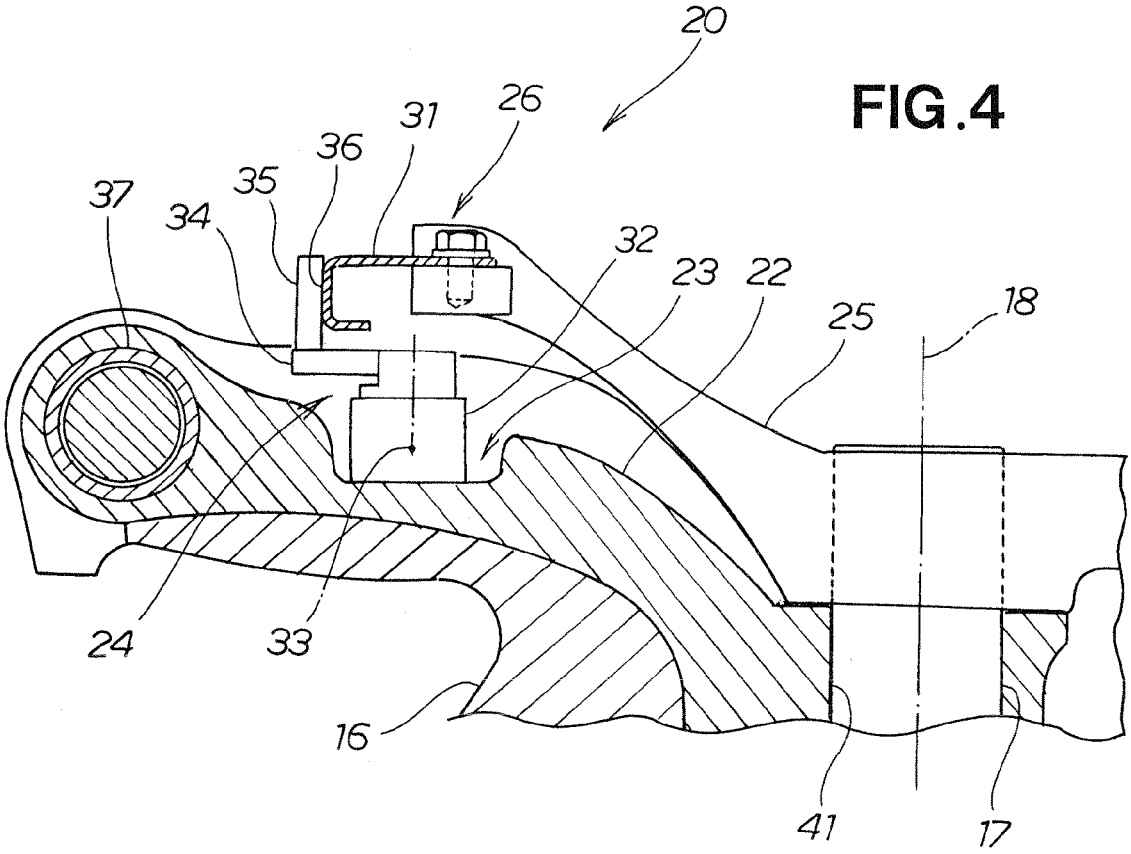
FIG. 4 is a sectional view taken along the 4-4 line of FIG. 3.

The following describe the primary sections of the outboard engine unit of the present invention, with reference to a sectional side view of FIG. 4. As shown in FIG. 4, the swivel case 22 is provided in contact with an upper surface portion of the stern bracket 16, the angle sensor 24 is provided in the region 23 immediately over the swivel case 22, and the curved member 31 is provided to face the angle sensor 24.

Although the curved member 31 is pivotable about the central axis 18 of the swivel shaft 17 without contacting the sensor body section 32, the contact 35 can always maintain its contact with the curved outer peripheral surface 36. Thus, the contact 35 angularly moves on the pivot member 34, i.e. varies in its operating angle, while sliding along the curved outer peripheral surface 36 in response to steering operation by the steerperson.

Figure 5:
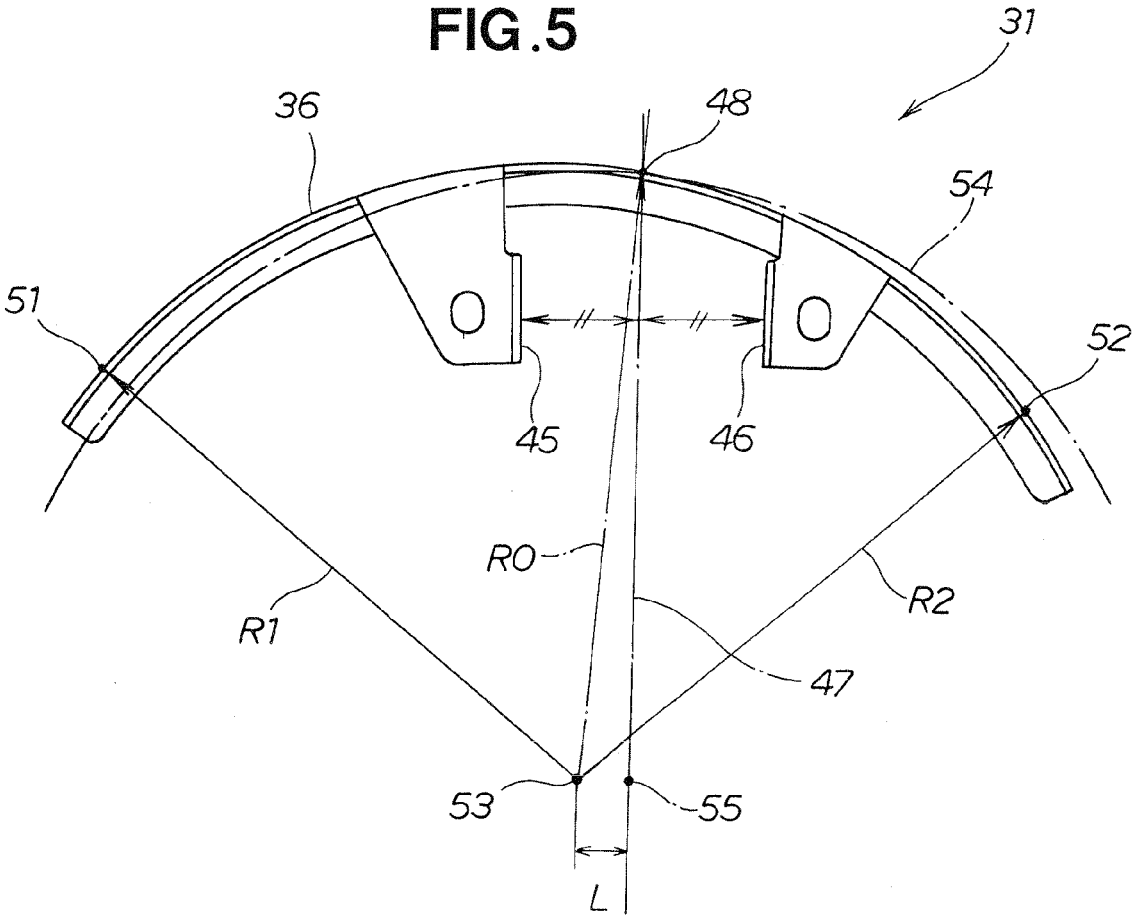
FIG. 5 is a plan view of a curved member provided in the outboard engine unit of the present invention.

The following describe in detail the shape of the curved member 31. In a plan view of FIG. 5, a line passing centrally between opposed mounting surfaces 45 and 46 of the curved member 31 will hereinafter be referred to as "imaginary reference line 47", and the reference line 47 and the curved outer peripheral surface 36 intersect with each other at an intersection point 48. FIG. 5 further shows a left-side point 51 and a right-side point 52 of the curved outer peripheral surface 36 located to the left and right, respectively, of the reference line 47, and normal lines passing the points 48, 51 and 52 perpendicularly to the curved outer peripheral surface 36. These normal lines passing the points 48, 51 and 52 intersect with one another at an imaginary center point 53. Further, in FIG. 5, distances from the imaginary center point 53 to the points 48, 51 and 52 are indicated by R0, R1 and R2, respectively, and these distances R0, R1 and R2 are set to establish a relationship of "R2<R0<R1"; namely, in the illustrated example of FIG. 5, the distance R1 near the left end of the curved outer peripheral surface 36 is the greatest among the distances. Furthermore, the imaginary center point 53 is spaced from the imaginary reference line 47 by a distance L, and an arc having a radius R0 from the imaginary center point 53 is indicated at 54.

Further, in FIG. 5, the swivel shaft 17 (FIG. 3) has a center 55 (corresponding to the central axis 18) that is located on the reference line 47, and a radius of curvature of the curved member 31 from the center 55 of the swivel shaft 17 varies continuously. Namely, the curved outer peripheral surface 36 is formed in a substantially arc shape having the imaginary center point 53 offset from the central axis 18 of the swivel shaft 17. In the instant embodiment, the distances R1 and R2 and the length of the pivot member 34 are chosen so as to allow the operating angle of the contact 35 of the sensor 24 to be less than half of the steered angle.

Figure 6:
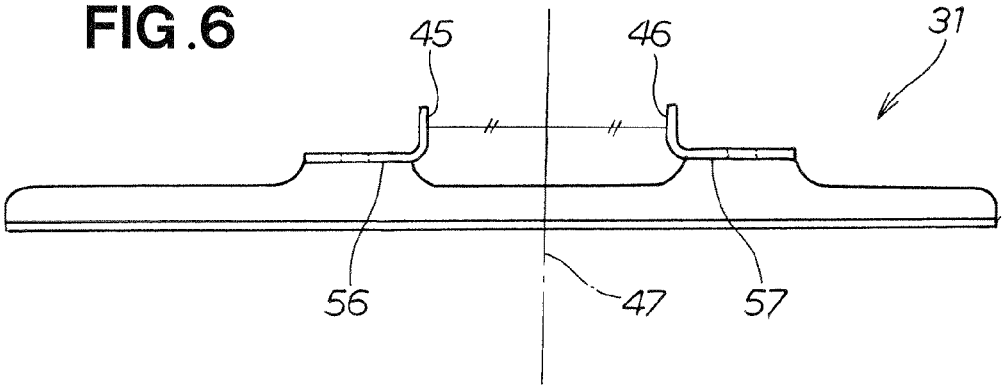
FIG. 6 is a front view of the curved member provided in the outboard engine unit of the present invention.

As shown in FIG. 6, the curved member 31 has bearing or seating surfaces 56 and 57 so that the curved member 31 can be reliably mounted on the distal end portion 26 of the mount frame 25 (FIG. 2).

Figure 7:
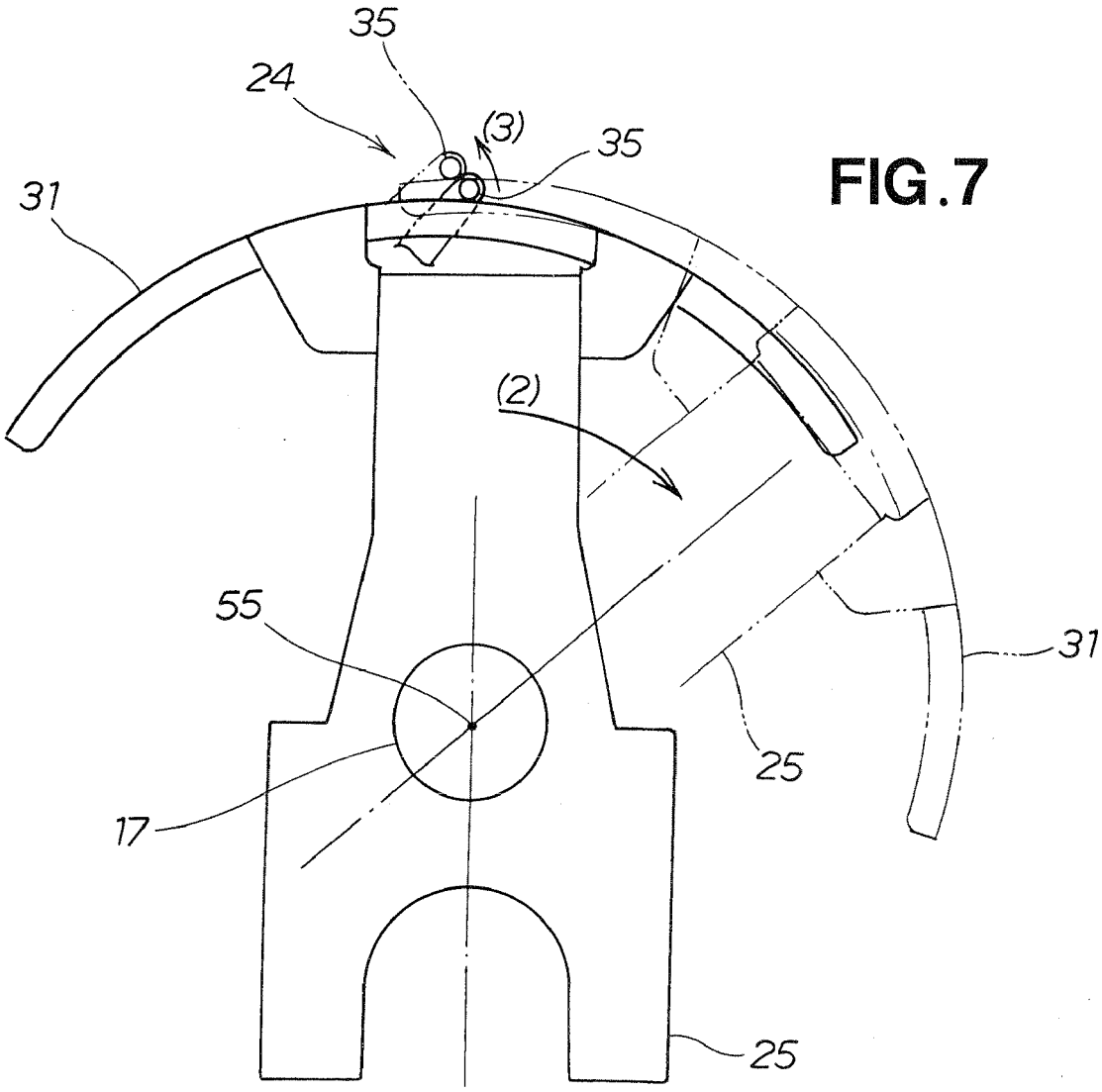
FIG. 7 is a view explanatory of behavior of the steered angle detection mechanism provided in the outboard engine unit of the present invention.
Figure 8:
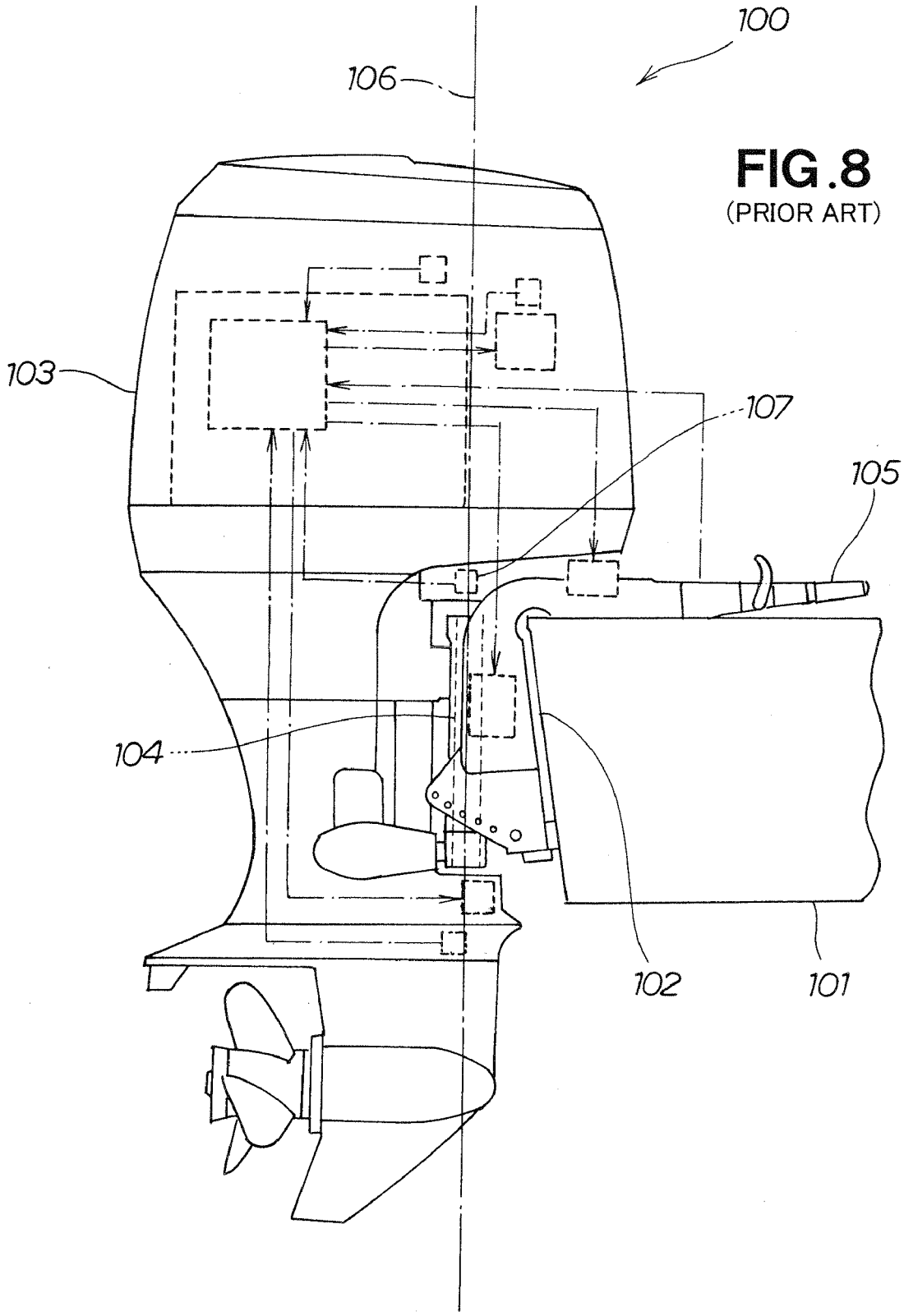
FIG.8 (PRIOR ART)
FIG. 8 is a view explanatory of behavior of a conventionally-known outboard engine unit.

The following describe behavior of the steered angle detection mechanism 20 constructed in the aforementioned manner. As shown in FIG. 7, the curved member 31 is normally held in sliding contact engagement with the contact 35. As the outboard engine body 19 (FIG. 1) is steered via the steering section 42, the mount frame 25 angularly moves (in a clockwise direction in the figure) to a position depicted by imaginary line as indicated by arrow (2), by which the contact 35 is angularly moved (in a counterclockwise direction in the figure) by the curved member 31, having the continuously varying radius of curvature, to a position depicted by imaginary line as indicated by arrow (3). In this way, a steered angle of the outboard engine body 19 can be detected via the angle sensor 24. More specifically, the arithmetic section 43 calculates the steered angle on the basis of the detection information from the angle sensor 24 using, for example, the memory-stored table as noted above.

In the embodiment of the outboard engine body of the present invention, as described above, the contact 35 can be kept at a relatively small operating angle even when the mount frame 25 has been moved a great distance and hence the steered angle has increased considerably. As a result, the outboard engine unit can achieve satisfactory performance even with the inexpensive angle sensor 24 in which the maximum operating angle of the contact 35 is not greater than half of the maximum steered angle. Note that the center 55 of the swivel shaft 17 is on the central axis 18 (FIG. 4) of the swivel shaft 17.

Whereas the preferred embodiment of the present invention has been described above as applied to the outboard engine steerable through operation of the steering handle, the present invention is also applicable to outboard engines steerable through operation of a tiller handle. Namely, the basic principles of the present invention are appropriately applicable to any other types of steerable outboard engines.

The present invention is well suited for application to outboard engines requiring detection of steered angles.

What is claimed is:

1. An outboard engine unit comprising:

an outboard engine body mounted via a swivel shaft to a stern bracket fixedly connected to a body of a boat, the outboard engine body being horizontally pivotable relative to the stern bracket up to a predetermined maximum steered angle about the swivel shaft;

an angle sensor provided on the stern bracket and including a contact having a maximum operating angle set to be not greater than half of the predetermined maximum steered angle, the angle sensor outputting detection information indicative of an operating angle of the contact; and a curved member provided on the outboard engine body and formed in a shape such that a radius of curvature thereof from a center axis of the swivel shaft varies continuously, the curved member being normally held in sliding contact engagement with the contact in such a manner that the contact varies in operating angle thereof while sliding along a curved outer peripheral surface of the curved member in response to steering operation.

2. The outboard engine unit according to claim 1, which further comprises a steering section for horizontally pivoting the outboard engine body about the swivel shaft, and wherein the steering section includes an arithmetic section for calculating a steered angle of the outboard engine body on the basis of the detection information output by the angle sensor, and a display section for displaying the steered angle calculated by the arithmetic section.

3. The outboard engine unit according to claim 1, wherein the curved outer peripheral surface of the curved member is of a generally arc shape having an imaginary center point offset from the central axis of the swivel shaft.

* * * * *